US005429287A

United States Patent [19]

Frano

[11] Patent Number: 5,429,287

[45] Date of Patent: Jul. 4, 1995

[54] ADJUSTABLE HIP-BRACE FOR A BACKPACK

[75] Inventor: Francis G. Frano, Hoffman Estates, Ill.

[73] Assignee: Illinois Tool Works Inc., Glenview, Ill.

[21] Appl. No.: 477,431

[22] Filed: Jan. 30, 1990

[51] Int. Cl.[6] ..... A45F 3/10

[52] U.S. Cl. ..... 224/215; 224/208; 224/262

[58] Field of Search ..... 224/208, 209, 210, 211, 224/212, 213, 215, 216, 259, 260, 261, 262, 263, 264

[56] References Cited

U.S. PATENT DOCUMENTS

| | | | |
|---|---|---|---|
| 3,347,429 | 10/1967 | Ruth, Jr. | 224/211 |
| 3,797,718 | 3/1974 | Plant | 224/262 |
| 3,899,109 | 8/1975 | Noice | 224/262 |
| 3,946,916 | 3/1976 | Lawrence | 224/262 |

FOREIGN PATENT DOCUMENTS

| | | | |
|---|---|---|---|
| 0049547 | 4/1977 | Japan | 224/215 |

*Primary Examiner*—Ernest G. Cusick
*Attorney, Agent, or Firm*—Schwartz & Weinrieb

[57] ABSTRACT

A backpack hip-brace assembly is disclosed, which individual hip-brace is interchangeable and operable upon either backpack frame side; is slidably positionable along the frame; and is laterally displaceable with respect to a wearer's body so as to pivot the backpack for redistribution of the load.

18 Claims, 2 Drawing Sheets

FIG.3
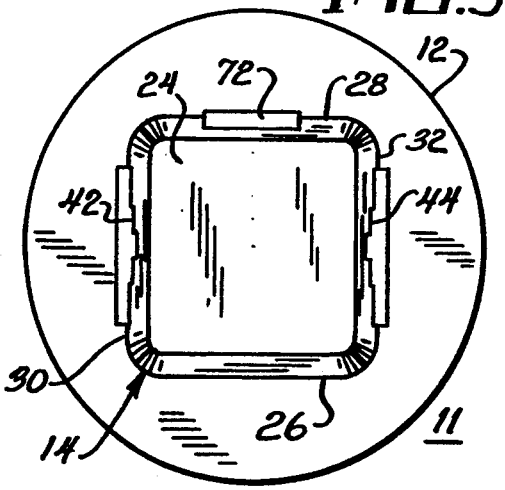
FIG.4
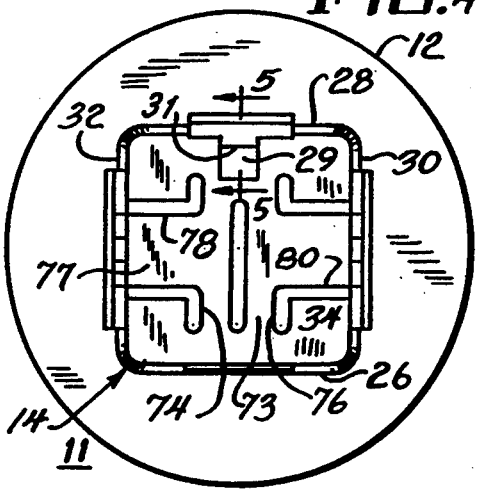
FIG.5
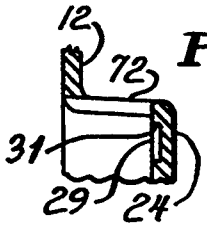
FIG.6
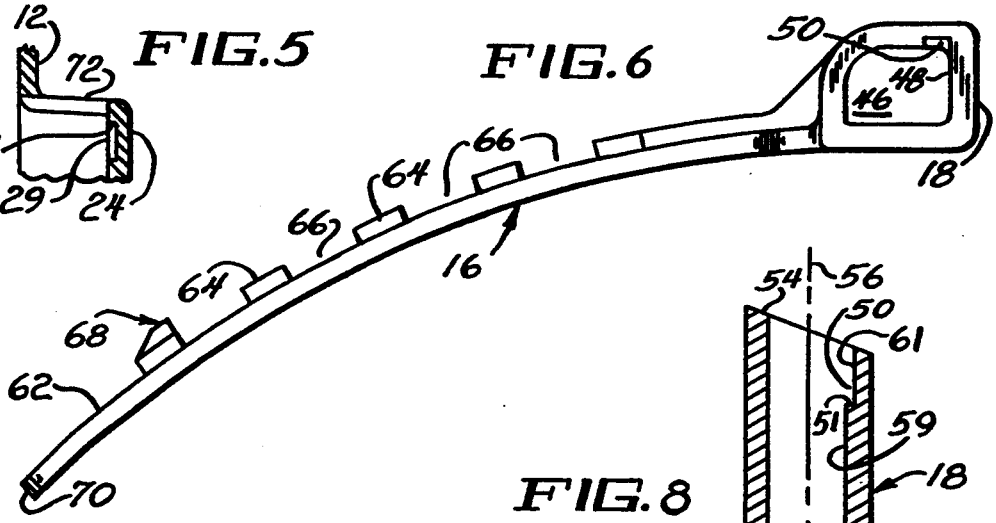
FIG.8
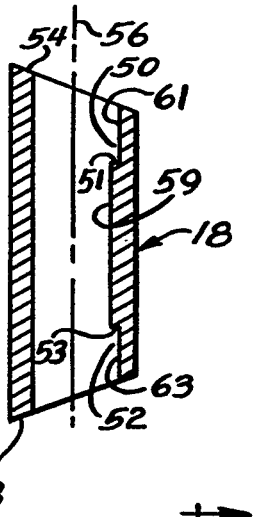
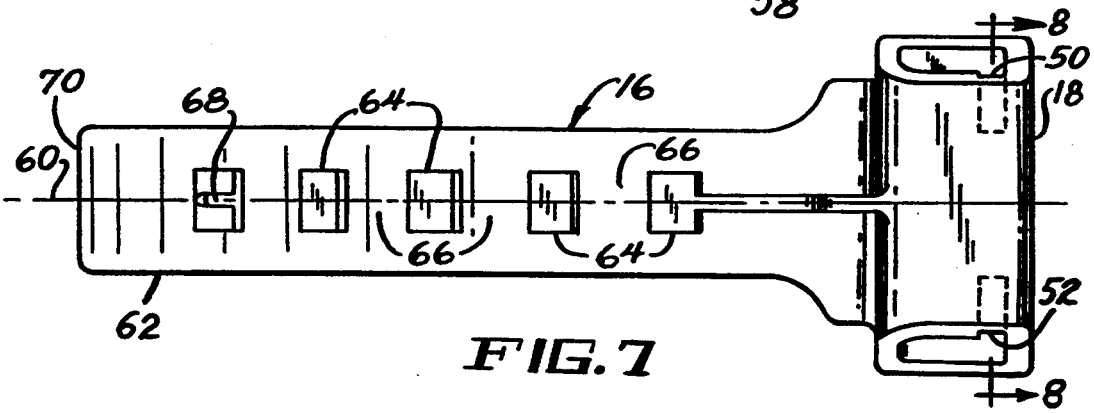
FIG.7

ADJUSTABLE HIP-BRACE FOR A BACKPACK

FIELD OF THE INVENTION

The present invention relates to a backpack assembly and more specifically to a hip-brace for a backpack, which is utilized to displace the base of the backpack from the user's hips to a safer, more desirable or more comfortable position.

BACKGROUND OF THE INVENTION

Backpacks traditionally have been utilized to transport and move food, clothing and equipment for hikers, campers and climbers. These backpacks may be double-strapped assemblies which are slung over a wearer's shoulders so as to maintain the pack upon the back of the user. Other backpacks have frames for bearing heavy or large loads, which frames are frequently tubular so as to minimize their weight. The frames maintain the shoulder-strapped load in position upon the wearer's back and keep the borne items in position. The pack is generally fitted so as rest upon the back and shoulders of the wearer, however, a heavy, poorly distributed or awkwardly balanced load disposed upon the wearer's back may cause fatigue, or induce him to fall. Therefore, it is frequently the practice, especially when ascending or descending hills or inclined surfaces, to relocate or reorient the pack upon or with respect to the wearer's body. The redistribution of the load upon the wearer provides a better balanced and forwardly displaced load while ascending and a more firmly secured load upon the wearer's body when progressing down a hill or inclined surface. This redistribution of the pack load has been found to provide a safer manner of travel for the wearer, and a more easily borne load so as to minimize wearer fatigue.

Hip brace assemblies disposed at the backpack wearer's hips can pivot the load with respect to the wearer's shoulders and away from the wearer's hips for the desired redistribution of the load. As noted above, this redistribution of the load provides a more comfortable position for bearing especially heavy loads in connection with awkwardly balanced or distributed loads or upon hilly or inclined terrain. Present hip brace assemblies utilize some means of contact against the user's hip, which have an arm extending between hip contact means and the backpack tubular frame. The arm is usually movable along the tubular frame to discrete locations and retained in position by securing means, such as, for example, a screw, nail or pin, or is alternatively fixed in position by means of collars and locking screws. The variation of the hip brace location and thus the degree of inclination from the user's hips may be limited by the number of securing ports or holes defined within the tubular frame. Adjustment of the hip-brace position along the tubular frame upon the backpack belt generally requires removal of the pack from the shoulders. Therefore, it is very desirable to provide a backpack hip-brace or apparatus providing continuous variability along the tubular frame without the necessity of utilizing a pin or screw, which must be removed by tools and can be easily lost or misplaced. Similarly, a screw and nut are currently utilized to secure the adjustment arm within the hip contact means, which again requires tools for adjustment of the arm as well as the utilization of easily-lost components.

A hip-brace assembly must be adoptable to currently available backpacks. Adjustment apparatus at the hip contact means should be readily incorporated within the brace assembly as well as being easily adjustable, wearer accessible and not require either tools or pack removal for such adjustment. In addition, a brace assembly usable upon either side of the wearer's body would minimize the required number of parts for production and inventory, as well as satisfying the necessity of utilizing only a single spare assembly for a backpacker trying to minimize his load.

SUMMARY OF THE INVENTION

The present invention provides a hip-brace assembly for a backpack, which is continuously variable along the backpack frame and is also easily adjustable away from the hip. Two braces are generally used per backpack, that is one for each hip, however, only one brace structure is required as it is operable upon either the right or left hip. Each brace has an insertable wedge so as to resiliently hold the extending arm at a selected position along the frame for subsequent securing by means of at least one collar, which allows variation of the brace along the backpack frame and provides the wearer with one mode of brace adjustability. The backpack is also adjustable by movement of the brace-assembly connecting arm within the hip-contact means, either toward or away from the wearer's body, so as to pivot the backpack upon the wearer's shoulders, which connecting arm is adjustable by merely depressing a retaining button and does not require either tools or pack removal for achieving such adjustment.

BRIEF DESCRIPTION OF THE DRAWINGS

Various objects, features, and attendant advantages of the present invention will become more fully appreciated, from the following detailed description, when considered in characters designate like or corresponding parts throughout the several views, and wherein:

FIG. 3 is a top plan view of the hip-brace yoke in FIG. 2;

FIG. 4 is a bottom plan view of the yoke in FIG. 2;

FIG. 5 is a partial sectional view of the yoke locking port in FIG. 4 taken along line 5—5 of FIG. 4;

FIG. 6 is a top plan view of the connecting arm and sleeve in FIG. 2;

FIG. 7 is an elevational view of the connecting arm and sleeve of FIG. 6;

FIG. 8 is a sectional view of the frame passage of the arm and sleeve in FIG. 7 taken along the line 8—8 of FIG. 7;

DETAILED DESCRIPTION OF THE INVENTION

Figure 1:
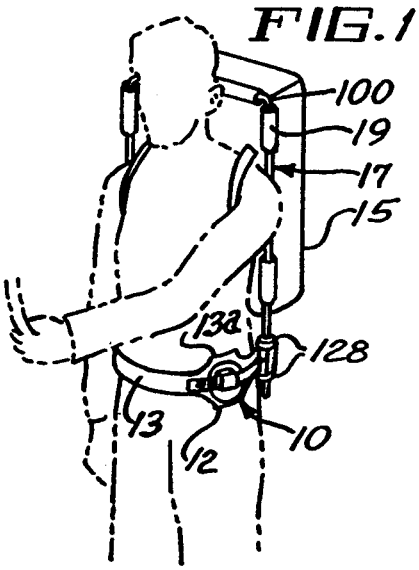
FIG. 1 is an illustration of a backpack and hip-brace assembly mounted upon an individual.
Figure 2:
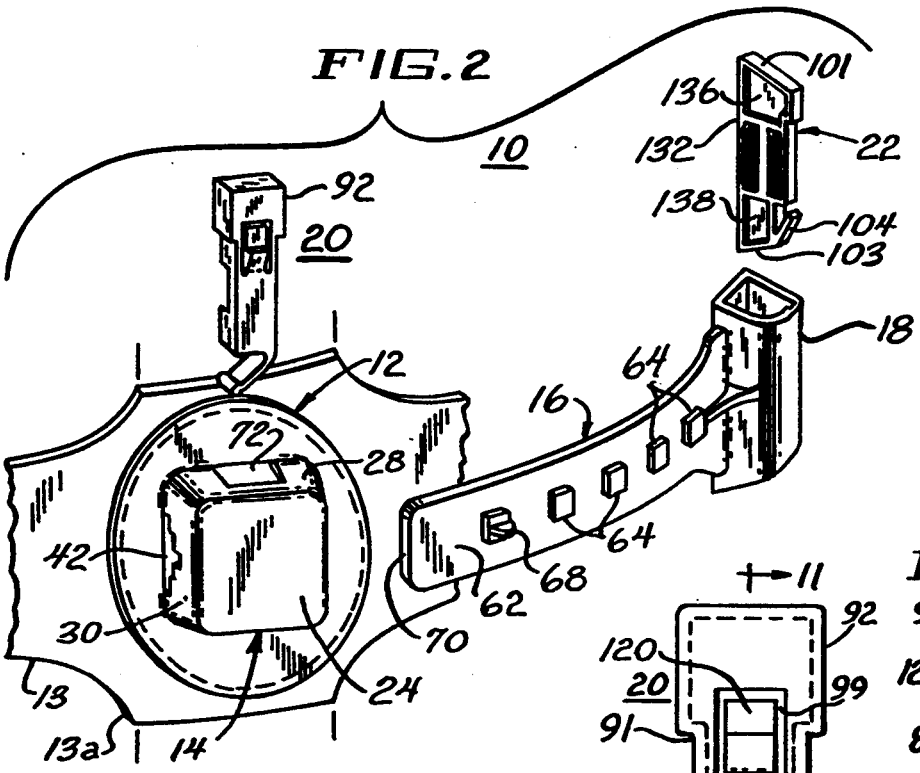
FIG. 2 is an exploded view of the hip-brace assembly of FIG. 1.

The present invention provides a hip-brace assembly 10, as illustrated in FIGS. 1 and 2, for a backpack 15, which hip brace 10 is operable so as to positively displace backpack 15 from the wearer's hips in order to redistribute the load upon or with respect to the wearer's body especially during ascent or descent along inclined terrain. Backpack frame 17 may be a tube 100, with an annular cross-section and formed in a U-shape, and having transverse coupling members, such as, for example, cloth straps 19, joining the opposite legs of the U-shaped tube. A hip brace assembly 10 for each frame leg has yoke 11 affixed to belt 13 at enlarged belt section 13*a* disposed approximately at the wearer's waist. Although two hip-braces are generally utilized by means of the backpacker, only one brace 10 will be described as the hip-braces may be used upon either hip by merely rotating yoke 11.

In FIG.2, a preferred embodiment of hip-brace assembly 10 has yoke 11 with body 14 positioned upon hip pad 12 for slidable mating with arm 16, which yoke 11 is affixed to enlarged belt or harness section 13*a* of belt 13 for securing about the wearer. As shown in FIGS. 3 and 4, body 14 has a generally rectangular shape with an outer wall or face 24, and normally extending first pair of parallel sidewalls 26, 28 and second pair of parallel sidewalls 30, 32 perpendicular to first sidewalls 26, 28. Hip pad 12 has a slight curvature or so as to conform to a wearer's body; however, in the Figures hip pad 12 appears generally parallel to body outer wall 24 and is mounted upon sidewalls 26–32 with enclosure 34 therebetween. Hip pad 12 may be mounted or attached to belt 13 by any means known in the art, such as, for example, directly stitching the same to enlarged belt section 13*a*.

In a first adjustment mode, arm 16 is slidably operable through aligned and parallel first arm slot or port 42 defined within in sidewall 30, second arm slot or port 44 defined within sidewall 32 and enclosure 34 so as to vary the position of backpack 15 from the wearer's hips. Arm 16 extends with respect to sleeve 18 and has an arcuate shape, as noted in FIGS. 2 and 6, for conformation with pad 12 and the user's body. A plurality of lugs 64 are spaced along arm's longitudinal axis 60 upon arm outer face 62 as seen in FIG. 7 with gaps 66 defined between adjacent posts or lugs 64. Lock 20 is insertable within body 14 between any pair of adjacent posts 64 so as to secure arm 16 and pack 15 at any of several discrete, fixed positions so as to, in turn, displace pack 15 with respect to user's hips. In the Figures, lugs 64 are equidistantly separated, which is merely for illustration and not limitation. Positive stop 68 at arm end 70 extends above the plane of the arc defined by means of the upper surfaces of aligned lugs 64 and retains arm 16 within yoke 11 against withdrawal beyond arm end 70.

Sleeve 18, which couples hip brace 10 and pack 15, is slidably adjustable upon tubes 100 of frame 17 in accordance with a second adjustment mode, and may be resiliently retained at any desired position upon tube 100 by means of wedge 22 for final securing by at least upper collar 128 as seen in FIG. 1. The first and second adjustment modes and the associated components thus accommodate both the horizontal and vertical placement, respectively, of hip-brace 10 and, consequently, the position of the backpack 15 upon the user. As shown in FIGS. 6–8, arm 16 projects from approximately the midpoint length of sleeve 18, which has a generally rectangular cross-section with passage 46 and inner wall 48. Aligned and coaxial first notch 50 and second notch 52 extend along inner wall 48 from upper end 54 and lower end 58, respectively, and are parallel to sleeve longitudinal axis 56. Ledge 59 defined between first and second notches 50, 52 is parallel with the notches and axis 56 but is displaced above the plane of the notches, as noted in FIG. 8. Sleeve ledge 59 has first shoulder 51 and second shoulder 53 extending from notch bases 61 and 63, respectively, so as to form the ledge terminus at each notch 50 and 52. The above-noted reference to upper and lower ends 54, 58 of sleeve 18 is related to sleeve 18 orientation in the Figures and is not a limitation as to the structure.

Figure 9:
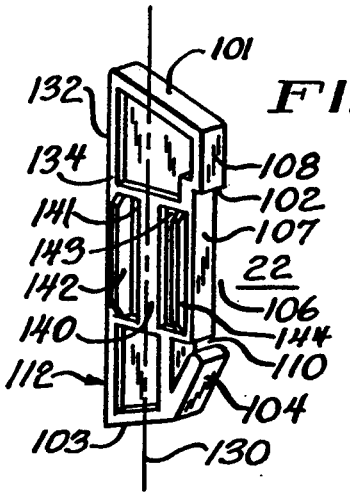
FIG. 9 is an enlarged perspective view of the securing wedge in FIG. 2.

Sleeve 18 has frame tubing 100 extending through sleeve passage 46, and is resiliently secured upon tube 100 by means of wedge 22. In FIGS. 2 and 9, wedge 22 is a relatively thin platelike member with a generally trapezoidal profile. Upper wall end portion 108 extends above the plane of upper wall 107 at first end 101 with shoulder 102 defined between end portion 108 and upper wall 107. Flexible tab 104 protrudes from opposite end 103 outwardly with respect to upper wall 107 with gap or recess 106 separating it from end portion 108. At opposite end 103, void 110 defined between flexible tab 104 and wedge body 112 is below the plane of upper wall 107, which allows deflection of tab 104 below the plane of wall 107 for positioning wedge 22 within passage 46. Insertion of the flexible tab end 103 into passage 46 of sleeve 18 initiates contact between sleeve wall 48 and tab 104 and deflects tab 104 into void 110. Subsequent nesting of shoulder 102 into one of notches 50,52, mates ledge 59 with recess 106 so as to align tab 104 for resilient recovery to its undeflected or reference position outwardly with respect to wall 107 and brings it into registry with the other notch 50,52, thus securing wedge 22 within sleeve passage 46.

Nesting of wedge 22 between tube 100 and wall 48 within passage 46 resiliently retains sleeve 18 upon tube 100 and thus maintains frame 17 at a desired vertical position relative to belt 13. In FIGS. 2 and 9, wedge 22 has a longitudinal axis 130 and parallel wedge base 132. Centrally-located first wedge face 134 is shown in the Figures with a first concave portion 136 and a second concave portion 138 at opposite wedge ends 101 and 103 and separated by means of a central plateau 140. First rib 142 and second rib 144 upon first face 134 are parallel to axis 130 and are separated by means of central plateau 140 and longitudinal slots 141, 143, respectively. Similar concave portions and rib structures are provided upon the reverse side (not shown) of wedge 22. Ribs 142, 144, which extend above the plane of wedge face 132, are in contact with wall 48 and tube 100 resiliently compresses plateau 140 when wedge 22 is inserted within sleeve passage 46 so as to resiliently retain arm 16 and sleeve 18 upon tube 100. Final securing and retention of sleeve 18 upon tube 100 is provided by slidably positioning at least upper collar 128 above sleeve 18 upon tube 100, although a second or lower collar 128 may also be utilized. As both faces of wedge 22 are provided with ribs 142, 144, it is appreciated that wedge 22 is operable with the brace upon either side of the wearer and tube frame, as well as being insertable at either end of passage 46. Collars 128 are exemplary securing means for sleeve 18 and alternative securing means may be utilized so as to fix sleeve 18 and arm 16 in position upon tube 100.

Figure 10:
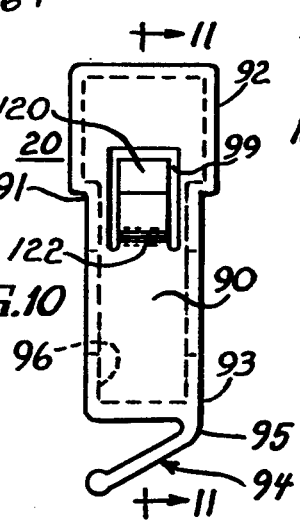
FIG. 10 is a front elevational view of the lock in FIG. 2.
Figure 11:
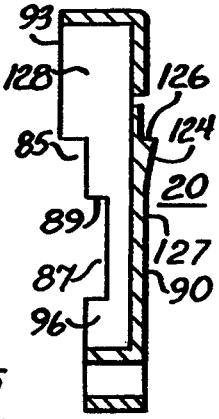
FIG. 11 is a side elevational view in section of the lock in FIG. 10 taken along the line 11—11 of FIG. 10.

Lock 20, in FIGS. 2, 10 and 11, is inserted and operable within enclosure 34 through means of locking port 72 defined within sidewall 28 so as to mesh with first groove 73 defined between parallel ribs 74 and 76 mounted upon outer wall 24 of enclosure 34 as best seen in FIG. 4. Lock 20 nests within one of the gaps 66 of arm 16 so as to secure arm 16. Port 72 may be provided within either sidewall 26 or 28 transverse to slots 42 and 44. Lock 20 is movable within first groove 73 as a result of the depression of head 92 from its reference position with sidewall panel 93 positioned within a gap 66 so as to bar movement of arm 16 to an arm-release position. At the arm-release position of lock 20, lugs 64 of arm 16 are slidable within second groove 77, which is aligned with slots 42 and 44 defined between ribs 78 and 80, and is transverse to groove 73 defined within enclosure 34.

Elongate panel 90 of lock 20 is illustrated in FIG. 10 with expanded head 92 at first panel end 91 and flexible foot 94 affixed to panel edge or sidewall 93 at second panel end 95. Flexible foot 94 can deflect and recover its reference position so as to bias lock 20 to its securing or reference position with shoulder 96 disposed within a gap 66 of securing arm 16 so as to secure arm 16 within yoke 11. In FIG. 11, lock sidewall 93 has a first groove 85 and a second groove 87, which intersect at shoulder 89. Depression of lock 20 from its securing and reference position moves lock second groove 87 into alignment with lugs 64 at the adjustment or arm-release position and permits slidable movement of arm 16 through enclosure 34. First groove 85 of lock 20 is juxtaposed with respect to arm outer surface 62 at the adjustment position so as to provide clearance and to act as a bearing surface in order to stabilize arm 16 during adjustment of backpack 15 in order to align lock 20 with respect to another one of gaps 66. Thereafter, flexible foot 94 biases lock 20 back the securing or reference position within a gap 66 and interposes shoulder 96 between a pair of lugs 64 so as to secure arm 16 within enclosure 34.

Lock 20 is retained within body 14 and enclosure 34 as a result of the engagement of shoulder 126 of retaining flap 120 with shoulder 31 defined at the intersection of recess 29 defined within body 14 at sidewall 28 as shown in FIGS. 4 and 5. Resilient retaining flap 120 which is shown in FIG. 10 as a rectangular element integral with and secured to panel 90 at one end 122 is generally centrally located within window 99 of panel 90, amp 124 with shoulder protrudes from panel outer surface 127 so as to engage shoulder 31 of recess 29 for retention of lock 20 within slot 72 and enclosure 34. Removal of lock 20 from body 14 for repair or replacement is achieved by depressing flap 120 into lock cavity 128 and withdrawing it from enclosure 34.

In operation, sleeve 18 has tube or leg 100 inserted within passage 46 and sleeve 18 is moved to any selected position along the tube length, Wedge 22 is thereafter inserted within passage 46 with minimal effort and no special tools, which deforms ribs 142 and 144 upon the reverse face of wedge 22 against sleeve sidewall 48, and tube 100 compresses plateau 140 for resiliently retaining sleeve 18 and arm 16 at a desired location for rigid securing by means of at least upper collar 128. If desired, a second collar 128 may be utilized below sleeve 18. Wedge 22 is positioned within passage 46 by deflecting flexible tab 104 and sliding wedge 22 into passage 48 until wedge shoulder 102 contacts one of notch shoulders 51 and 53, which nests sleeve ledge 59 within recess 110 and shoulder 102 in one of notches 50,52. Flexible tab 104 is positioned within the other notch 50,52 and flexibly recovers as to engage the other shoulder 51,53 and retain wedge 22 within passage 46. It can be appreciated that insertion of wedge 22 within passage 46 with either wedge face abutting tube 100 will have the same resilient retaining action, as there are a pair of ribs 142, 144 upon both wedge front surface 134 and its reverse face.

Adjustable arm 16 extends through slots 42,44 and enclosure 34 of yoke 11 and is movable so as to vary the lower portion of pack 15 between a pack reference position, where the pack is substantially aligned with the user's back as noted in FIG. 1, and any of several discrete positions displaced from the user's hips, which displacement is determined by means of the displacement of arm 16 away from yoke 11. Lock 20 is retained within enclosure 34 by means of the engagement of shoulder 126 and flap 120 with shoulder 31 of recess 29, but may be depressed so as to facilitate or enable immediate adjustment of the backpack position. Depression of lock 20 within yoke 11 moves first and second lock grooves 85,87 into registry with arm outer surface 62 and lugs 64, respectively, thus permitting sliding movement of arm 16 within yoke 11 to the desired discrete position with lock 20 aligned with a selected gap 66. Thereafter, release of lock 20 nests lock shoulder 96 within one of gaps 66 so as to fix the selected pack displacement, as flexible tab 94 biases lock 20 to the lock reference position. Arm 16 is inhibited against inadvertent withdrawal from yoke 11 by positive stop 68 contacting lock sidewall 93 when arm 16 has been extended to its maximum displacement.

Although only one hip-brace 10 has been described, it is readily apparent that a second yoke 11 may be mounted upon belt 13 at the second hip position with transverse slot 72 provided at the vertical location by merely rotating arm 16 about its longitudinal axis 60, whereby a second hip-brace arrangement similar to brace 10 is provided at the second hip. Therefore, only a single hip-brace structure or design is required, but is operable at either hip position, thus reducing costs associated with the production of independent parts for the right or left hip as well as reducing the inventory carrying costs for the supplier. Similarly, the user is not required to inventory a separate brace for each hip, but can accommodate a brace replacement at either hip with only one assembly.

While only a specific embodiment of the invention has been described and shown, it is apparent that various alterations and modifications can be made therein. It is, therefore, the intention of the appended claims to cover all such modifications and alterations as may fall within the scope and spirit of the invention.

What is claimed is:

1. A hip-brace assembly, for displacing a backpack, having a frame and a support belt, from a user's hip, comprising:

a yoke;

a coupling sleeve with an arm extending therefrom, said sleeve having a longitudinal axis and a passage for movably receiving a portion of said backpack frame;

a locking wedge insertable within said sleeve passage so as to resiliently retain said sleeve at a selected location upon said backpack frame;

said arm having an outer face with a plurality of lugs defining discrete and selectable locking gaps between adjacent ones of said plurality of lugs, said arm being matable with said yoke; and locking means engageable with said yoke and operable so as selectively register with one of said locking gaps of said arm so as to secure said arm when mated within said yoke at a selected position so as to fix said backpack at a selectable distance from said yoke and said user's hip.

2. A hip brace assembly as claimed in claim 1, wherein:

said yoke is mounted upon said belt for securing said backpack about said user's hip.

3. A hip brace assembly as claimed in claim 1, wherein:

said locking wedge has a front face and a rear face; and at least one deformable rib is mounted upon each one of said front and rear faces, said ribs being resiliently deformable so as to secure said sleeve and said arm upon said backpack frame.

4. A hip brace assembly as claimed in claim 1, further comprising:

means for securing said sleeve at said selected location upon said backpack frame.

5. A hip brace assembly as claimed in claim 4, wherein:

said securing means comprises a first collar;

said sleeve has a top side and a bottom side with respect to said sleeve longitudinal axis;

said backpack frame comprises a formed tube with at least one side leg slidably extending through said sleeve passage; and said first collar is slidably mounted upon said tube so as to rigidly secure said sleeve at said top side of said sleeve.

6. A hip-brace assembly as claimed in claim 1, wherein:

said yoke comprises a housing with a rear wall, a sidewall extending from said rear wall, and a pad mounted upon said housing side wall, said pad cooperating with said rear wall and said sidewall of said housing so as to define an enclosure;

said sidewall defining a first port, a second port, and a third port, two of said first, second, and third ports being parallel and aligned so as to receive said arm for engaging said yoke, and the other one of said ports being transversely located with respect to said two aligned ports;

a first rib and a second rib mounted upon said rear wall and disposed within said enclosure, said first and second ribs defining a slot aligned with said other one of said ports;

said arm having a generally longitudinal second axis normal to said sleeve axis, said plurality of lugs being mounted and spaced upon said arm at predetermined distances along said second axis defining said locking gaps between adjacent ones of said lugs; and said locking gaps being selectively alignable with said rear wall slot, and said locking means being insertable within said other port and said slot so as to be disposed within one of said aligned locking gaps so as to secure said arm at a desired position so as to displace said frame and said backpack from said user's hip at a predetermined distance therefrom.

7. A hip-brace assembly as claimed in claim 6, wherein:

said locking wedge has an upper wall with a first end, and a second end;

an end portion at one of said first and second ends protrudes above said upper wall, and a shoulder extends between said end portion and said upper wall;

a flexible finger is secured to said upper wall at the other one of said first and second ends;

said flexible finger and said shoulder cooperate so as to define a recess therebetween;

said coupling sleeve having a first sleeve end, a second sleeve end, and an inner wall, said inner wall having a first notch and a second notch at said first and second ends, respectively, with a protruding ledge therebetween;

said locking wedge being insertable within said sleeve passage so as to position said end portion within one of said first and second notches and said flexible finger within the other one of said first and second notches with said protruding ledge nested within said locking wedge recess, whereby said locking wedge engages and resiliently retains said backpack frame within said sleeve passage at a selected position.

8. A hip-brace assembly as claimed in claim 7, wherein:

said locking wedge upper wall defines a void at the other one of said first and second ends, said void being generally aligned with said flexible finger; and said flexible finger is operable between a notch-engaging position and a deflected position at which said finger is moved into said void so as to provide clearance for said ledge during removal and insertion of said locking wedge from said sleeve.

9. A hip-brace assembly as claimed in claim 7, wherein:

said arm has a first arm end and a second arm end, one of said first and second arm ends being coupled to said sleeve and the other one of said first and second arm ends having one of said lugs, in proximity to said other arm end, provided with a positive stop extending from said one of said lugs so as to contact said locking means and thereby prohibit withdrawal of said arm from said yoke.

10. A hip-brace assembly as claimed in claim 9, wherein:

each of said lugs has a top surface, and said positive stop is secured upon said top surface of said one of said lugs.

11. A hip-brace assembly as claimed in claim 9, wherein:

said locking means has a body with a lower end, a top end having an expanded head, and an edge wall with a locking shoulder; and biasing means, mounted upon said locking means lower end, for operably contacting said side wall of said housing so as to move and maintain said locking shoulder into and within one of said locking gaps for retention of said extending arm and said backpack at said selected position.

12. A hip-brace assembly as claimed in claim 11, wherein:

said biasing-means is a flexible foot affixed to and extending from said locking means body so as to engage said sidewall of said housing.

13. A hip-brace assembly as claimed in claim 12 wherein said locking means and biasing means are an integral assembly.

14. A hip-brace assembly, for use with a backpack having a frame with first and second legs and belt means, said hip-brace assembly having a first hip-brace and a second hip-brace, identical to said first hip-brace, positionable upon said first and second legs, respectively, and adjustable means for selectively securing said first and second hip-braces upon said respective legs, each of said first and second hip-braces respectively comprising:

a coupling sleeve having a first longitudinal axis and a through-passage disposed along said longitudinal axis and through which one of said first and second legs of said backpack frame slidably extend, respectively;

a locking wedge insertable within each one of said respective through-passages between one of said frame legs and said respective sleeve so as to resiliently retain said respective sleeve at a selected location upon a respective one of said frame legs;

an arm connected to a respective one of said coupling sleeves and having a plurality of lugs aligned thereon, each pair of adjacent lugs cooperating with each other so as to define a locking gap therebetween;

a yoke mounted upon said belt means and having a hip pad, and a rear wall with a sidewall normally extending therefrom and coupled to said hip pad, such that said rear wall, said sidewall, and said hip pad cooperate with each other so as to define an enclosure;

said belt means being positioned about a wearer so as to secure said hip pad against said wearer's hip;

said sidewall of said yoke defining a first port and a second port aligned with and parallel to said first port, and a third port disposed substantially normal to said first and second aligned ports, said arm being slidable within said yoke through said first and second aligned ports and said enclosure; and locking means insertable within said third port for selectively engaging any one of said locking gaps of said arm so as to move said arm and said backpack to a predetermined and selectable position and distance from said yoke and said wearer's hips.

15. A hip-brace assembly as claimed in claim 14, wherein:

said locking wedge comprises an upper wall with a first end and a second end, a protruding portion at said first end and a flexible finger at said second end, said protruding portion and flexible finger cooperating so as to define a recess therebetween along said upper wall;

said coupling sleeve having a first upper sleeve end, a second lower sleeve end, and an inner wall having an aligned first notch and a second notch with a protruding ledge therebetween; and said flexible finer is deflectable for permitting insertion of said locking wedge into said coupling sleeve so as to mate said protruding portion of said locking wedge within one of said first and second notches and said flexible finger within the other one of said first and second notches while said sleeve ledge is in registry with said locking wedge recess.

16. A hip-brace assembly as claimed in claim 15, wherein:

said locking wedge further comprises a front surface and a rear surface, at least one flexibly deformable rib upon each one of said front and rear surfaces, a slot defined within each of said front and rear surfaces so as to be disposed parallel to each one of said ribs, and a central plateau upon each one of said front and rear surfaces so as to be substantially coplanar with a respective one of said front and rear surfaces, said ribs being deformed, during insertion of said locking wedge, between an interior wall of said sleeve and a respective one of said front and rear surfaces of said locking wedge with one of said frame legs compressively acting upon said central plateau of the other one of said front and rear surfaces of said locking wedge so as to resiliently retain said sleeve and said arm upon said one of said frame legs.

17. A hip-brace assembly as claimed in claim 16, wherein:

said adjustable means for securing said first and second hip-braces upon said frame legs comprises an annular collar upon said respective frame leg, which collar contacts said sleeve at said upper sleeve end.

18. A hip-brace assembly as claimed in claim 17, further comprising:

a second annular collar mounted upon said respective frame legs, wherein said second collar is mounted upon said lower sleeve end so as to secure said respective sleeve between said first and second collars.

* * * * *